United States Patent [19]

Margulies

[11] 4,436,221

[45] Mar. 13, 1984

[54] CONTAINER AND DISPENSING PLATE FOR A ROLL OF PRE-MOISTENED TOWELETTES

[75] Inventor: Herman Margulies, Westfield, N.J.

[73] Assignee: Sterling Drug Inc., New York, N.Y.

[21] Appl. No.: 950,616

[22] Filed: Oct. 12, 1978

[51] Int. Cl.[3] ..... A47K 10/38

[52] U.S. Cl. ..... 221/46; 206/409; 221/63; 383/71

[58] Field of Search ..... 221/44–63; 225/106, 52; 206/205, 389, 395, 396, 397, 409; 229/62; 220/404; 242/55.54

[56] References Cited

U.S. PATENT DOCUMENTS

| | | | |
|---|---|---|---|
| 2,981,990 | 5/1961 | Balderree | 229/62 UX |
| 3,749,296 | 7/1973 | Harrison | 225/106 |
| 3,843,017 | 10/1974 | Harrison | 221/63 |
| 3,868,052 | 2/1975 | Rockefeller | 225/106 |
| 3,908,822 | 9/1975 | Giberstein | 206/278 |
| 3,973,695 | 8/1976 | Ames | 221/63 |
| 3,979,019 | 9/1976 | Bliss | 221/48 |
| 3,986,479 | 10/1976 | Bonk | 221/47 X |
| 3,994,417 | 11/1976 | Boedecker | 221/63 X |
| 4,017,002 | 4/1977 | Doyle et al. | 221/63 |

*Primary Examiner*—F. J. Bartuska

*Attorney, Agent, or Firm*—Wenderoth, Lind & Ponack

[57] ABSTRACT

A package and dispensing device for a continuous roll of pre-moistened towelettes which has an outer container that holds therein the roll of pre-moistened towelettes, the roll being surrounded by a bag which prevents the roll from drying out. The towelettes are pulled away from the roll through a hole in a sealing and dispensing plate and are pulled out of the top of the container.

9 Claims, 9 Drawing Figures

CONTAINER AND DISPENSING PLATE FOR A ROLL OF PRE-MOISTENED TOWELETTES

BACKGROUND OF THE INVENTION

The present invention relates to a package and a dispensing plate primarily for use in dispensing and separating pre-moistened towels or smaller towelettes from a continuous web of towelling material.

Pre-moistened sheets or towelettes are increasingly popular among consumers because they are convenient and easily provide a "damp cloth" even when water is not readily available. For the most part, these sheets are either individually wrapped or come as part of a continuous web which is rolled and perforated so that it can be separated into a plurality of individual sheets. This invention relates to the dispensing of the sheets or towelettes packaged as a rolled, continuous web.

Presently, rolls of towelettes are delivered to the consumer in a plastic container with a separable top removably fitted over the container. The top has a specifically designed outlet for withdrawing the towelettes on the roll therethrough and for subsequently separating the individual towelettes from the roll. Novelty among different containers and tops lies primarily in the construction of the opening through which the towelettes are required to pass as they are removed from the roll. The opening must be large enough to permit the towelettes to fit therethrough and, at the same time, must be small enough to exert enough frictional pull on the towelettes to cause them to separate along the perforated dividing lines.

Several examples of previously patented containers include: U.S. Pat. No. 4,017,002 to Doyle et al., wherein the opening is a combination of cross-slits; U.S. Pat. No. 3,994,417 to Boedecker, wherein the towelette is withdrawn through a plate which has a single circular opening therethrough; U.S. Pat. No. 3,868,052 to Rockefeller, wherein an opening is provided which has protrusions directed toward the central portion of the opening; U.S. Pat. No. 3,843,017 to Harrison, wherein the opening has a flap thereacross which slightly engages the continuous web as it is withdrawn through the opening; and U.S. Pat. No. 3,973,695 to Ames, wherein the opening is an elongated opening through which the continuous web is withdrawn.

While all of these prior art towelette dispensers seem to function well and achieve their goal of separating the individual towelettes from the continuous perforated web, there are drawbacks. The major drawback and area for improvement is the total packaging concept which currently requires expensive materials for forming the package, much hand labor, and, ultimately disposal of the spent container. The dispenser/containers now available are almost entirely formed from extruded and molded plastics, have a top with the specific type of outlet therethrough positioned on top of the container with the web thereinside, and require that the web be initially fed through the opening so that it is ready to be used. Also, the dispensing opening must be conveniently sealed in some way to prevent the pre-moistened towelettes from drying out before reaching the consumer, and finally, since the containers are of rigid plastic, the disposal of them creates problems—they are bulky even when empty and create polluting fumes when they are burned.

SUMMARY OF THE INVENTION

It is, therefore, an object of the present invention to provide a new and improved package for storing and dispensing a continuous wed of pre-moistened sheets or towelettes.

Furthermore, it is also an object of the invention to provide a package which is lightweight and easily and economically formable, and is readily and conveniently disposable. Also, the package can be formed and prepared for marketing with a minimum of manual labor.

The objects of this invention are achieved by providing a moisture-proof container which contains a pre-moistened roll of towelettes thereinside within a moisture-proof bag. A special dispensing plate with a slit and a hole therein rests on top of the roll of towelettes and the end of the web of towelettes projects therethrough. The towelettes slide through the slit into the hole which is large enough to allow the towelettes to be withdrawn easily therethrough, but which is small enough to insure that friction is exerted on the web to cause the individual towelettes to separate from each other.

BRIEF DESCRIPTION OF THE DRAWINGS

Further objects and a better understanding of the novel features of the present invention will become apparent from the following detailed description taken with the drawings, wherein.

FIGS. *3a–3c* and *4a–4c* are top views of various embodiments of the dispensing plate of this invention.

DETAILED DESCRIPTION OF THE INVENTION

Figure 1:
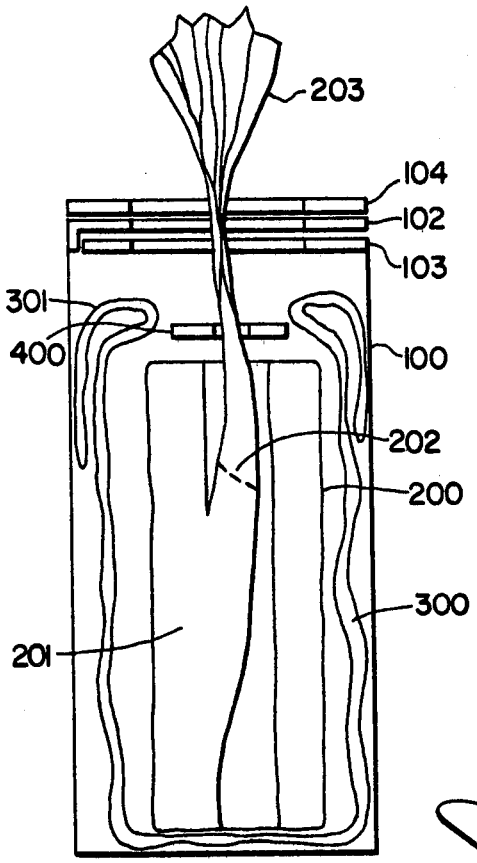
FIG. 1 is a section view of one embodiment of this invention.

FIG. 1 shows the general configuration of a dispensing package of the present invention. An outer container 100 holds therein a roll 200 of pre-moistened towelettes. The roll 200 within the container is also surrounded by a bag 300 which helps to prevent the roll drying out. The top 301 of the bag is opened and folded back inside the outer container 100. The towelettes are pulled away from the roll 200 and out of the top of the bag 301 through the dispensing plate 400.

The outer container 100 may be of any construction which will suitably contain the roll 200. For ease in assembly and disposal, a simple paper box which is treated to be moisture resistance (for example, the paper may be plastic-coated) is adequate. This will provide a container which is lightweight, yet sturdy, and which will increase the ease of handling and stacking the rolls. It is, of course, recognized that other containers with other shapes and constructions may also serve adequately.

Figure 2:
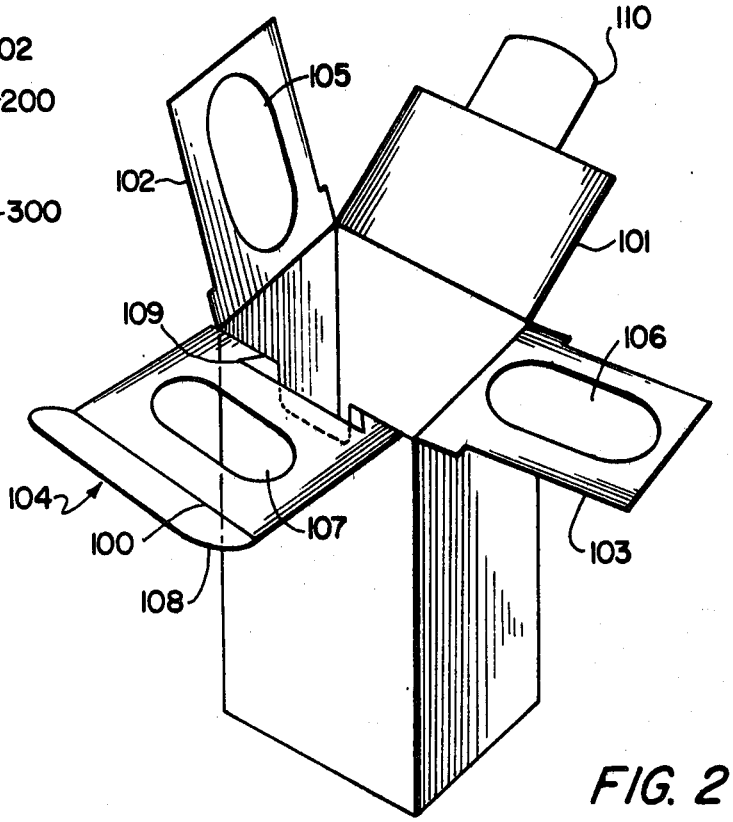
FIG. 2 is a perspective view of the container of this invention.

The container 100 of FIG. 2 has four sides, a bottom, and a hinged top 101. The top, when opened, reveals three flaps 102, 103, 104 with openings 105, 106, 107 respectively therethrough. When these three flaps are folded across the top of the box, the openings are aligned and the end towelette of the roll 200 can be pulled therethrough. The top side flaps 102, 103 are designed to be folded one on top of the other, and the third flap 104 is folded over the other two. A hinged edge 108 fits inside the top of the container when the third flap 104 is folded into position. This third flap 104 also has an opening 109 therein which receives a hinge-edged extension 110 of the top 101 when the top is closed over the folded flaps. The extension 110 then extends inside the container and helps to secure the top in a closed position. By simply opening the integrally hinged top 101, the end of the towelettes through the aligned openings are exposed, and the towelettes can be pulled easily therethrough to remove them from the container.

The bag 300 for containing the roll 200 functions primarily to prevent the pre-moistened towelettes from drying out before they reach the consumer and before the consumer uses all of them. To fulfill this function, nearly any lightweight, flexible plastic bag will do; however, any other material which will inhibit vaporization of the moistening liquid in the roll may also be used for the bag and the same results will be obtained, for example, a polyethylene plastic bag. After the roll 200 is first inserted into the bag 300, the bag is closed in any manner which will effectively seal it shut, such as heat sealing the top edges 301 together. When it is time to withdraw the towelettes, the bag 300 is opened, and the top edges 301 are folded back.

The actual roll 200 of towelettes is a continuous web 201 which is perforated at 202 along the length thereof to form a plurality of sheets or towelettes 203 which can be separated from the remainder of the roll 200 by simply detaching along the perforations 202. The technique of forming such a roll 200 is not new, and it is possible for this invention to function when the end of the web 201 is withdrawn from either the inside of the roll or the outside. Furthermore, it is also possible to utilize either cored or coreless rolls of this web material, since the bulk or width of the roll is sufficient to support the roll in a vertical position while the towelettes are drawn therefrom. Also, the web material may be moistened with many different types of fluids depending on the determined usage of the towelettes, and, therefore, this invention is not intended to be limited to any specific type of pre-moistened towelette.

Figure 3A:
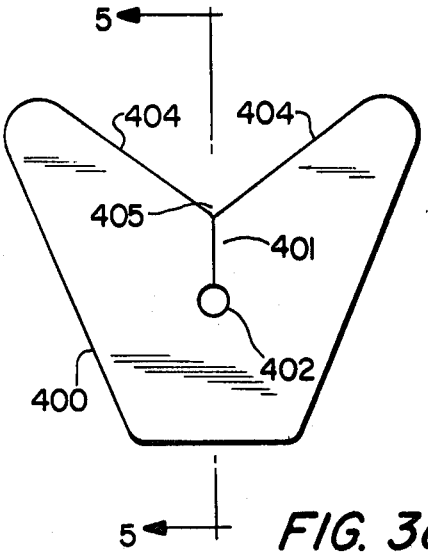
Figure 4A:
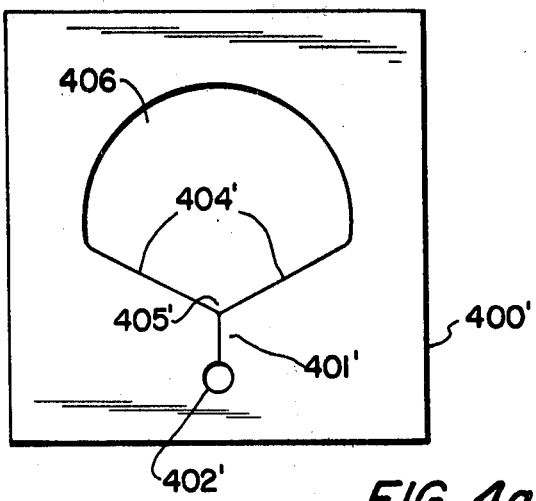

Two general embodiments for the dispensing plate are shown in FIGS. 3*a* and 4*a*. Each plate 400, 400' has a narrow slit 401, 401' which is directly connected to a hole or opening 402, 402'. The end of the roll 200 of towelettes is pulled through the narrow slit and then into the hole. The holes 402, 402' are, of course, sufficiently large enough to allow the towelettes 203 to be withdrawn from the inside of the bag 300 therethrough. A significant feature of the openings 402, 402', however, is the fact that while the openings must be large enough to allow the towelettes 203 to be drawn therethrough, they must, at the same time, provide enough friction to the web so that the towelettes will separate at their perforations 202 as they are pulled therethrough.

The principle distinction between the two plates of FIGS. 3*a* and 4*a* is in the construction of the opening space which leads into the slit 401. In FIG. 3*a*, the plate 400 simply has sloping sides 404 leading into the top end 405 of the slit 401; the sloping sides 404 facilitate guiding the end of the towelettes 203 into the slit 401. The variation in FIG. 4*a* shows a larger hole 406 in the plate 400' at the top end 405' of the slit 401', and the hole 406 has sloping sides 404' at the bottom thereof leading directly into the slit 401'. To use this second embodiment of the plate 400', the towelette 203 is pulled through the hole 406 and then pulled between the sloping sides 404' into the slit 401' and toward the hole 402'. Then, in either embodiment, the towelette 203 is in the smaller hole 402, 402', and the plate 400 remains around the top of the roll 200 with the end towelette therein-side. The height of the bag 300 remains substantially constant, since the roll 200 is on end, and only the diameter of the roll decreases as the towelettes 203 are drawn therefrom, and not the height.

Figure 5:
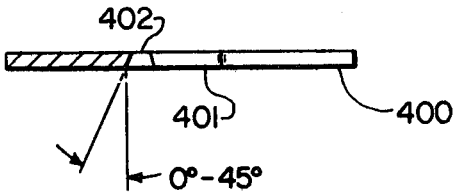
FIG. 5 is a sectional view of the dispensing plate of this invention along line 5—5 of FIG. *3a*.

The plate 400, it should be emphasized, may have almost any outer edge configuration, i.e., circular, square, polygonal, etc., as long as there is a slit therein with sloping sides leading into it at one end and the slit has a hole at the other end. Also, even though the holes 402, 402' may be any opening through the plate 400 at the end of the slits 401, 401', as shown in FIGS. 3 and 4, it is preferred that the hole be circular, and furthermore, this circular hole may have a conical profile through the plate (see FIG. 5) that is angled from 0° to 45° to facilitate withdrawing the towelette 203 therethrough. The plate, itself, should be made from a fairly rigid material, such as a light metal or rigid plastic, so that it will not deform greatly at the slit or hole when the towelette is pulled therethrough.

Figure 3B:
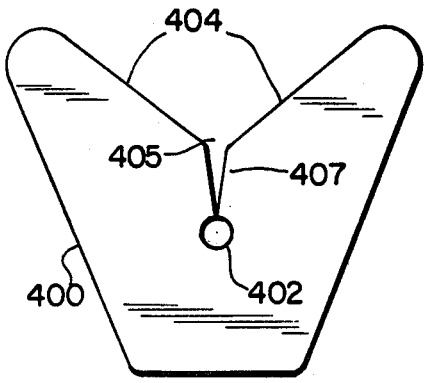
Figure 4B:
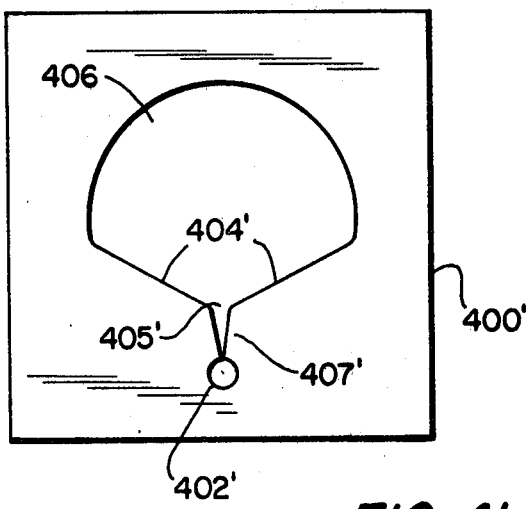
Figure 3C:
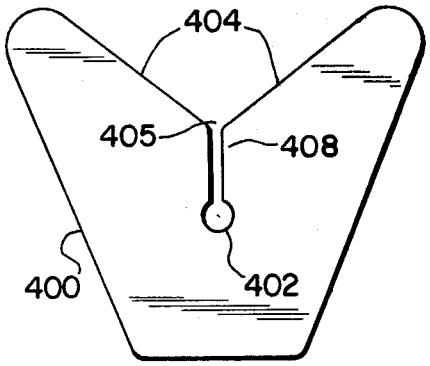
Figure 4C:
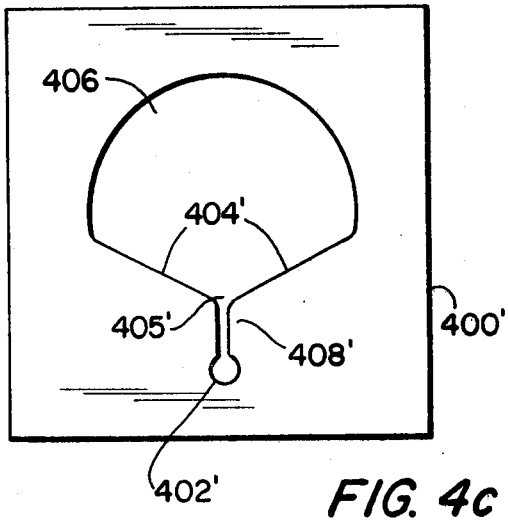

In FIGS. 3*a* and 4*a*, the slits 401 and 401' are of the type usually created by cutting or slitting the material comprising the plate; that is, even after the slit is created, both sides thereof will probably contact each other. On the other hand, FIGS. 3*b*, 3*c*, 4*b* and 4*c* show further modifications of the slit configuration. FIGS. 3*b* and 4*b* show slits 407, 407' which are cut in a V-shape converging from the sloping sides 404, 404' toward the openings 402, 402'. FIGS. 3*c* and 4*c* show slits 408, 408' which consist of an opening with spaced parallel sides extending from the sloping sides 404, 404' toward the openings 402, 402'. In each of these various embodiments, the slit is designed to facilitate pulling the towelette from the open area at one end of the slit into the dispensing opening.

After the pre-moistened roll 200 of the towelettes is packaged in the bag 300, and the bag is appropriately sealed, such as by heat sealing, the bag then must be torn or cut open at the top by any suitable means by the consumer when it is time to withdraw the towelettes. This assures that the moisture remains in the roll until the towelettes are used. Once the bag 300 is open, the consumer may then easily affix the dispensing plate 400 around the end towelette 203 by pulling the end of the roll of towelettes out of the bag and sliding the towelette 203 along the sloping sides 404 of the plate 400 into the slit 401 and the opening 402. The dispensing plate 400 is then allowed to rest on top of the roll 200 within the bag. As an alternative the dispensing plate may be received by the consumer in position around the end towelette of the roll already inside a sealed bag. This way, all that is necessary to prepare the package for use is to open the top of the bag; dispensing of the towelettes through the plate can begin immediately.

One additional convenience of the dispensing plate 400 of this invention is the ease with which the towelettes 203 can be threaded therein, especially if the roll of towelettes should tear before the next towelette emerges through the dispensing hole 402. The user needs only to remove the plate 400, pull up the next length of towelette 203 and slide it into the slit 401 and hole 402 as before.

Finally, since the package is designed to be made of lightweight materials, which are easily collapsible, disposal of the container after all of the towelettes are removed may be easily and efficiently accomplished.

It is recognized that further embodiments and modifications of the above-described invention are possible within the scope of this invention, and therefore, it is not intended that the invention be limited to those embodiments specifically presented.

What is claimed is:

1. A package for dispensing and separating single sheets from a continuous roll of pre-moistened sheets which are joined at perforations, said package comprising:

container means for housing therein a continuous roll of pre-moistened sheets;

bag means positioned within said container means and surrounding said roll for containing said roll therein and for preventing said pre-moistened sheets of said roll from drying out; and dispensing plate means, separate from and positioned within said container means, surrounding an end sheet of said roll for dispensing said end sheet therethrough, whereby said end sheet will tear from the next sheet in said roll at the perforations when said end sheet is drawn through said dispensing plate means, said dispensing plate means comprising a substantially rigid plate having therethrough a dispensing opening of a dimension to allow said end sheet to slide therethrough, a slit having a first end opening into said dispensing opening and a second end, and sloped edges converging into said second end of said slit from an outer edge of said plate, whereby said end sheet slides through said slit into said dispensing opening.

2. A package as claimed in claim 1, wherein said container means comprises a liquid-impervious paper box having a plurality of sides, a bottom and a top hinged to at least one of said sides, and at least one flap hinged to one of said sides and covering the top portion of said box underneath said top, said flap having an opening therethrough through which said end sheet of said roll extends.

3. A package as claimed in claim 2, wherein said box is plastic-coated and has three hinged flaps dimensioned to completely overlap each other when folded beneath said top, said three flaps having openings which are completely aligned when said flaps are folded beneath said top.

4. A package as claimed in claim 1, wherein said bag means is a plastic bag surrounding said roll.

5. A package as claimed in claim 1, wherein said opening dispensing in said plate is circular.

6. A package as claimed in claim 1, wherein said dispensing opening is conical-shaped, a smaller end of said conical shape being at the top surface of said plate.

7. A device for dispensing and separating a single perforated sheet from a continuous roll of sheets which are joined at perforations, said device comprising a substantially rigid plate having therethrough a dispensing opening dimensioned to allow an end sheet of a roll to slide therethrough, a slit having a first end opening into said dispensing opening and a second end, and sloped edges converging toward said second end of said slit from an outer edge of said plate, whereby said end sheet of said roll slides through said slit into said dispensing opening, and the remaining sheets are pulled directly through said dispensing opening.

8. A device as claimed in claim 7, wherein said dispensing opening in said plate is circular.

9. A device as claimed in claim 7, wherein said dispensing opening is conical-shaped, a smaller end of said conical shape being at the top surface of said plate.

* * * * *

UNITED STATES PATENT AND TRADEMARK OFFICE

CERTIFICATE OF CORRECTION

PATENT NO. : 4,436,221

DATED : March 13, 1984

INVENTOR(S) : Herman MARGULIES

It is certified that error appears in the above-identified patent and that said Letters Patent is hereby corrected as shown below:

Column 2, line 45, "drying out" should read --from drying out--.

Column 6, Claim 5, line 2, "opening dispensing" should read --dispensing opening--.

Signed and Sealed this

*Twenty-third* Day of *April 1985*

[SEAL]

*Attest:*

DONALD J. QUIGG

*Attesting Officer* *Acting Commissioner of Patents and Trademarks*